US006810940B2

(12) United States Patent
Tsuji et al.

(10) Patent No.: US 6,810,940 B2
(45) Date of Patent: Nov. 2, 2004

(54) DRIVE CONTROL METHOD FOR A SQUEEZE PIN

(75) Inventors: Makoto Tsuji, Kanagawa-ken (JP); Toshiaki Nakano, Kanagawa-ken (JP); Toshioki Toyoshima, Kanagawa-ken (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 147 days.

(21) Appl. No.: 10/142,928

(22) Filed: May 13, 2002

(65) Prior Publication Data

US 2002/0167104 A1 Nov. 14, 2002

(30) Foreign Application Priority Data

May 11, 2001 (JP) ..... 2001-142320

(51) Int. Cl.[7] ..... B22D 27/11
(52) U.S. Cl. ..... 164/120; 164/319
(58) Field of Search ..... 164/120, 319, 164/320

(56) References Cited

U.S. PATENT DOCUMENTS 5,161,598 A 11/1992 Iwamoto et al.
5,787,963 A * 8/1998 Tsuji et al. ..... 164/120

FOREIGN PATENT DOCUMENTS

JP 4-118167 4/1992

* cited by examiner

*Primary Examiner*—Kuang Y. Lin
(74) *Attorney, Agent, or Firm*—Pillsbury Winthrop LLP

(57) ABSTRACT

It is necessary for the stroke of squeeze pin to be controlled so as to reach a defined target stroke position or zone during each shot operation of a die-casting machine. To achieve such control of squeeze pin, controlled variables T, Q or P are set in a trial molding process. The setting operation of the controlled variable is executed in a short time automatically. In case of adopting flow rate Q supplied to the squeeze cylinder as a controlled variable, the initial setting value Q1 is defined as 50% with conversion of opening degree of a flow control valve.

Then, if the stroke of the pin is out of target, flow rate Q2 is set, which is defined as 75% corresponding to a intermediate value between the maximum degree of opening 100% and 50% at Q1. In a similar way, flow rates Q3, Q4, Q5 are set, namely, each Q3, Q4, Q5 is defined as the intermediate value between controlled variables set in consecutive two shots ahead. In case of Q5 the detected stroke of the squeeze pin is within the target stroke zone.

3 Claims, 12 Drawing Sheets

DRIVE CONTROL METHOD FOR A SQUEEZE PIN

BACKGROUND OF THE INVENTION

1. Field of the Invention

The present invention relates to a pressure casting process, especially relates to a drive control method for a squeeze pin used in the process.

2. Description of Related Art

Generally, in a pressure casting such as an operation in a die-casting machine, volume contraction arises in molten metal when it is injected into a mold cavity and solidifice therein. Then, shrinkage holes occur in mold article, which influence undesirable effects on strength and air-tight of the mold article.

Especially, in the die-casting machine, there is provided with a sharp slope of temperature, and shrinkage holes occur frequently. Therefore, various ways to avoid occurrence of such shrinkage holes have been proposed. A typical way is to use a pin which squeezes molten metal to homogenize matrix of a mold article by protruding into a cavity after the molten metal is injected and filled in the cavity. FIGS. 4 to FIG. 12 illustrate such way to use a squeeze pin.

FIG. 4 illustrates a main composition of a die-casting machine. In FIG. 4, numeral 1 designates a pair of mold dies. Molten metal 4 is teemed or injected into a cavity 2 formed by the mold dies 1. The mold dies 1 are formed with a moving mold die 5 and a fixed mold die 6. The moving mold die 5 is mounted on a moving die plate 51, and the fixed mold die 6 is mounted on a fixed die plate 61.

Operation for die clamping or die opening and closing is executed by moving the moving die plate 51. An injection sleeve 3 is mounted on the fixed die plate 61. An opening portion at the most right top of the sleeve 3 communicates through a gate 7 with the cavity 2. The molten metal 4 in the sleeve 3 is injected to the cavity 2 by an injection plunger 8 which is slidably inserted in the injection sleeve 8. The injection plunger 8 is driven by a injection cylinder 9 which is co-axially arranged with the injection sleeve 3. Numeral 10 designates a detector mounted on the injection cylinder 9 for detecting an injection pressure.

Also, in the mold dies 1, there are provided with a squeeze pin 11 and a squeeze cylinder 12 to drive the squeeze pin 11 between the moving mold die 5 and the moving die plate 51.

The squeeze pin 11 is inserted in a hole 13 located on the moving die 5 with its top capable of protruding into the cavity 2. The squeeze cylinder 12 and the squeeze pin 11 are arranged co-axially.

Also, there is provided with a stroke sensor 14 inside the squeeze cylinder 12 for detecting stroke quantities or length of the squeeze pin 11. This stroke sensor 14 is an absolute type of position detector using a differential transformer, which output signal to an identical stroke position is always kept to be the same because of determining the position of origin by the sensor itself.

Namely, as shown in FIG. 6, there are provided with a sleeve like coil portion 16 screwed into a bore formed inside a piston 17 of the squeeze cylinder 12, and a core 18 movably inserted therein, fixedly mounted on a cylinder head 15 of the squeeze cylinder 12.

Accordingly, the sleeve like coil portion 16 generates a signal corresponding to relative displacement between the core 18 and the coil portion 16 when the piston 17 moves in the cylinder 12.

The squeeze pin 11 is fixedly connected with the piston 17 (not shown in FIG. 6).

Therefore, the stroke quantity of squeeze pin 11 can be detected by means of a position of the piston 17. An increment type of stroke sensor may be used. However, such type of sensor needs a signal corresponding to the position of origin that brings about space or environment problems. Therefore, it is preferable to use the absolute type of stroke sensor.

In FIG. 4, each output signal of the stroke sensor 14 and the injection pressure sensor 10 is applied to an input unit 21 of a controller 20 which provides with a central processing unit (CPU) 22, a memory 23 and an output unit 24 besides the input unit 21. The output unit 24 is connected through an amplifier 25 to a solenoid valve 26 which directly controls the operation of the squeeze cylinder 12.

Also, numeral 27 designates a control apparatus for controlling various operations of a die-casting machine, which is connected to the controller 20 to input various control information such as initial value $S_0$ of optimal stroke length and etc.

FIGS. 8 (*a*) and (*b*) show wave forms of the injection pressure P and the piston stroke $S_0$ in relation to a drive control operation of the squeeze pin 11. As shown FIG. 8, an count timer 201 starts its time counting operation at the time when the injection pressure P reaches a set value $P_0$ (at the time of switching to boosting). When the time counting operation reaches time up state, that is, a time interval $T_0$ passes, the count timer 201 generates a signal so as to switch the solenoid valve 26, which in turn causes the squeeze cylinder 12 to move the squeeze pin 11, thereby squeeze operation being executed.

FIG. 7 shows a control block diagram of the controller 20. In FIG. 7, actual stroke quantity Sa of the squeeze pin 11 is detected by the stroke detector 14 and then it is fed back to confirm whether or not the detected value Sa is within a target zone (allowance zone) $S_0 \pm \alpha$. Based on the confirmation, a correct means 200 supplies to the count timer 201 a corrected time interval $T_0 \pm \Delta T$ where $\Delta T$ is small time unit as a parameter stored in the memory 23. Then, next step of injection molding is executed.

In the next step, the count timer 201 starts its time counting operation at the time when the injection pressure P reaches the set value $P_0$ stored in the memory 23. When the corrected time interval $T_0 + \Delta T$ elapses by the counting operation, the count timer 201 generates the signal so as to switch the solenoid valve 26, which in turn causes the squeeze cylinder 12 to move the squeeze pin 11, thereby squeeze operation being executed in accordance with the corrected time interval.

In a trial molding process, each molding step is repeated by modifying the time interval in such a way described above so that the stroke of actual squeeze pin 11 comes into the optimal target zone $S_0 + \alpha$.

FIG. 5 is a flow chart showing a process for drive control of the squeeze pin 11. At the step 1 of FIG. 5, parameters such as injection pressure $P_0$, optimal stroke $S_0$, allowance zone $\pm\alpha$ for the optimal stroke $S_0$, code $N_0$ of mold die 1, time interval $T_0$ corresponding to time up of count timer 201, small time unit $\Delta T$ for modifying the time interval $T_0$ and shot repeat number n for modifying the time interval $T_0$ are preset. At the step 2, injection operation starts. Then, at the step 3, the injection pressure P detected by the pressure senor 10 is compared with the preset value $P_0$. When detected injection pressure P reaches preset value $P_0$, the count timer 201 starts to the counting operation. Then, at the step 4 it is judged that the count timer 201 becomes time up or not. In case of time up, at the step 5, the timer 201 supplies a signal through the output unit 24 to the solenoid valve 26 which causes the squeeze cylinder 12 to move the squeeze pin 11. As the squeeze pin 11 moves, molten metal 4 in the cavity 2 is squeezed.

The squeezed molten metal 4 is also on the way to solidification. When the solidification progresses to an extent, the squeeze pin 11 can not move further and stops. At the step 6, the stroke sensor 14 detects a stroke Sa of the squeeze pin 11 when it stops. Then, at the step 7, the detected stroke Sa is compared with the optimal stroke $S_0$ stored in the memory 23 at the CPU 22, and judged whether or not the detected stroke Sa is within the target zone $S_0 \pm \alpha$. In case of the stroke Sa to be within the target zone, the initial preset value of time interval $T_0 \pm \Delta T$ is stored in the memory 23 at the step 10 and then, next injection molding process is started.

In case of the stroke Sa to be out of the target zone, at the step 9 a new time interval is defined by adding or reducing by a small time unit $\Delta T$ to the time interval $T_0$, and then, the next injection molding process is started.

Namely, in case that the stroke Sa is less than the lower target point $S_0 - \alpha$, it may be happened that the solidification completes before the squeeze pin 11 reaches preset stroke $S_0$. Accordingly, the new time interval is defined as $T_0 - \Delta T$ so as to advance starting time of the squeeze pin 11.

On the other hand, in case that the stroke Sa is larger than the upper target point $S_0 + \alpha$, it may be happened that the solidification doe not complete when the squeeze pin 11 reaches preset stroke $S_0$. Accordingly, the new time interval is defined as $T_0 + \Delta T$ so as to delay starting time of the squeeze pin 11.

As described above, reference set stroke is defied as a sum of the preset stroke $S_0$ and its allowance $\pm\alpha$. The controller 20 always executes feed back control so that detected actual stroke Sa of the squeeze pin 11 comes into the target zone $S_0 \pm \alpha$.

Further, there is provided with a display unit 200 capable of displaying the detected stroke Sa in a digital ways, thereby making easy to compare and evaluate with real products In the above description of the flow chart shown in FIG. 5, the number of shot "n" at the step 8 is assumed to be "1", and in case of the judgment at the step 7 to be "NO", modification of the time interval at the step 9 is executed at each shot. However, in case of the number "n" to be plural, for instance, "8", the time interval $T_0$ is modified at every 3 shots based on two consecutive shots ahead.

Furthermore, a specific criterion may be used. Then, under the criterion, detected actual time intervals are stored in the memory 23 in relation to each mold die and molding conditions thereof; which are used as initial values in the next injection molding.

In the above description, the present P of injection cylinder 9 is used as a criterion to determine the time interval of the squeeze pin 11. However, other physical elements such as hydraulic power, injection speed, injection stroke and distortion of mold die or pin for pushing out an article could be used as the criterion. Also, in the above description, the stroke sensor 14 is arranged in the squeeze cylinder 12. However, such arrangement of the stroke sensor 14 has a drawback of mounting a precise detector inside the mold die. Japanese patent laid open No.8-132211, discloses a squeeze pin drive method which is unnecessary to use the stroke sensor 14. In this method, as shown in FIG. 4, there is provided with a flow meter counter 100 for measuring flow rate of pressurized hydraulic fluid supplied to squeeze cylinder 12. The stroke quantity of squeeze pin 11 can be measured indirectly by means of the flow meter counter 100. Furthermore, No.8-182211 discloses a method in which time interval to start the squeeze pin, pressure P of hydraulic fluid supplied to squeeze cylinder or its flow rate Q could be changed when difference between the detected stroke of squeeze pin and the set stroke thereof is over a defined stroke quantity.

FIG. 9 illustrates a control block diagram for controlling the squeeze cylinder using the above physical quantities T, P, Q and particularly, the dashed line portion Z indicates a control portion concerning compensation quantities $\Delta$ T, $\Delta$P, $\Delta$Q. FIG. 10 is a time chart for explaining stroke operation of the squeeze pin with respect to FIG. 9. FIG. 11 illustrates a stroke waveform S in accordance with one stroke operation of squeeze pin closingly following to solidification and shrink or contraction of molten metal in a mold cavity. In more detail, the stroke operation starts after injection pressure P reaches preset value P1 and time interval elapses. Then, the stroke operation progresses until a desired stroke end within a target zone.

In a stroke control operation of the squeeze pin above described, if a difference between actual detected stroke and its target value exists, in other words, if the stroke position is out of target zone, the correction or modification required is executed so as to gradually approach a desired position in such a manner that, as shown in FIG. 9, a unit quantity $\Delta$A T, $\Delta$P, or $\Delta$Q for compensating, each being predetermined as a parameter, is added or reduced unit by unit to each corresponding preset value.

Namely, in the stroke control operation, even if full of the deviation to target quantity measured during one shot operation is applied for the next stroke operation, the actual stroke in the next short does not necessarily converge to the target, because the solidification process of molten metal filled in a cavity is too complex to correctly understand both of the temperature lowering and the volume contraction, and under the present level of metal and die-casting technology it is inevitable to use an indirect controlled variable such as T, P, or Q.

Accordingly, as shown in FIG. 9, it is practical to asymptotically approach a target stroke by applying a small unit quantity of compensation factor $\Delta$T, $\Delta$P, or $\Delta$Q for one time correction.

However, in trial molding, such an asymptotical approach requires many times of shot operation for reaching target stroke after initial setting, as shown in FIG. 12. (FIG. 12 illustrates an asymptotical approach more than 10 times to reach target zone.)

An object of the present invention is to provide a new drive control method of a squeeze pin which overcomes the drawback that many times of shot operation for reaching target stroke are required during trial molding by means of an asymptotical approach mentioned above.

SUMMARY OF THE INVENTION

To achieve the above object, a drive control method of a squeeze pin according to the present invention is constituted as followings.

In a drive control method for pushing a squeeze pin slidably mounted on a squeeze cylinder in a mold die into a mold cavity formed in conformity with a desired mold article in accordance with solidification processes of molten metal in the cavity after the molten metal is filled therein, the method comprising the steps of:

setting a target point or a target zone on a stroke quantity of the squeeze pin for molding the mold article, defining values of a controlled variable in accordance with at least one of time lag T, flow rate Q and supply pressure P those are concerned in driving the squeeze pin, wherein the time lag T is a time interval between a time instance when injection pressure reaches a predetermined value and a time instance when the squeeze pin starts to operate, the flow rate Q is a flow rate of pressurized hydraulic fluid supplied to the squeeze cylinder and the supply pressure P is pressure values of the hydraulic fluid supplied to the squeeze cylinder, executing first trial molding for the article one or several times based on the defined values of the controlled variable, and detecting each actual stroke quantity of the squeeze pin during the trial molding, firstly modifying or holding the controlled variable by defining intermediate values between the defined values and maximum values of the controlled variable to be allowed as new values of the controlled variable in case that actual stroke quantities detected during the first trial molding are less than the target point or zone, by defining intermediate values between the defined values and minimum values of the controlled variable to be allowed as new values of the controlled variable in case that the actual stroke quantities are larger than the target point or zone and by holding the defined values in case that the actual stroke quantities are within the target point or zone, executing second trial molding for the article one or several times based on the firstly modified or hold values of the controlled variable, and detecting each actual stroke quantity of the squeeze pin during the second trial molding, secondly modifying the controlled variable by defining intermediate values between the modified values and the values immediately before the firstly modifying as new values of the controlled variable in case that the actual stroke quantities of the squeeze pin during the second trial molding are out of target point or zone, executing third trial molding for the article one or several times based on the secondly modified values of the controlled variable, and as the result holding the secondly modified values as that of controlled variable thereafter in case that the actual stroke quantities of the squeeze pin during the third trial molding are within the target point or zone, and figuring out intermediate values between the secondly modified values of controlled variable and the values immediately before the secondly modifying in case that the actual stroke quantities of the squeeze pin during the third trial molding are out of target point or zone.

It is preferable that the firstly modifying comprises figuring out difference between values of controlled variable and values of target point or zone, and modifying values of controlled variable so as to be proportional to the difference.

According to the present invention, the numbers of shot operation necessary for reaching target stroke in trial molding are greatly reduced.

DETAILED DESCRIPTION OF THE PREFERRED EMBODIMENT(S)

The embodiment according to the present invention will be explained below with reference to the attached drawings FIG. 1 to FIG. 3.

Figure 1:
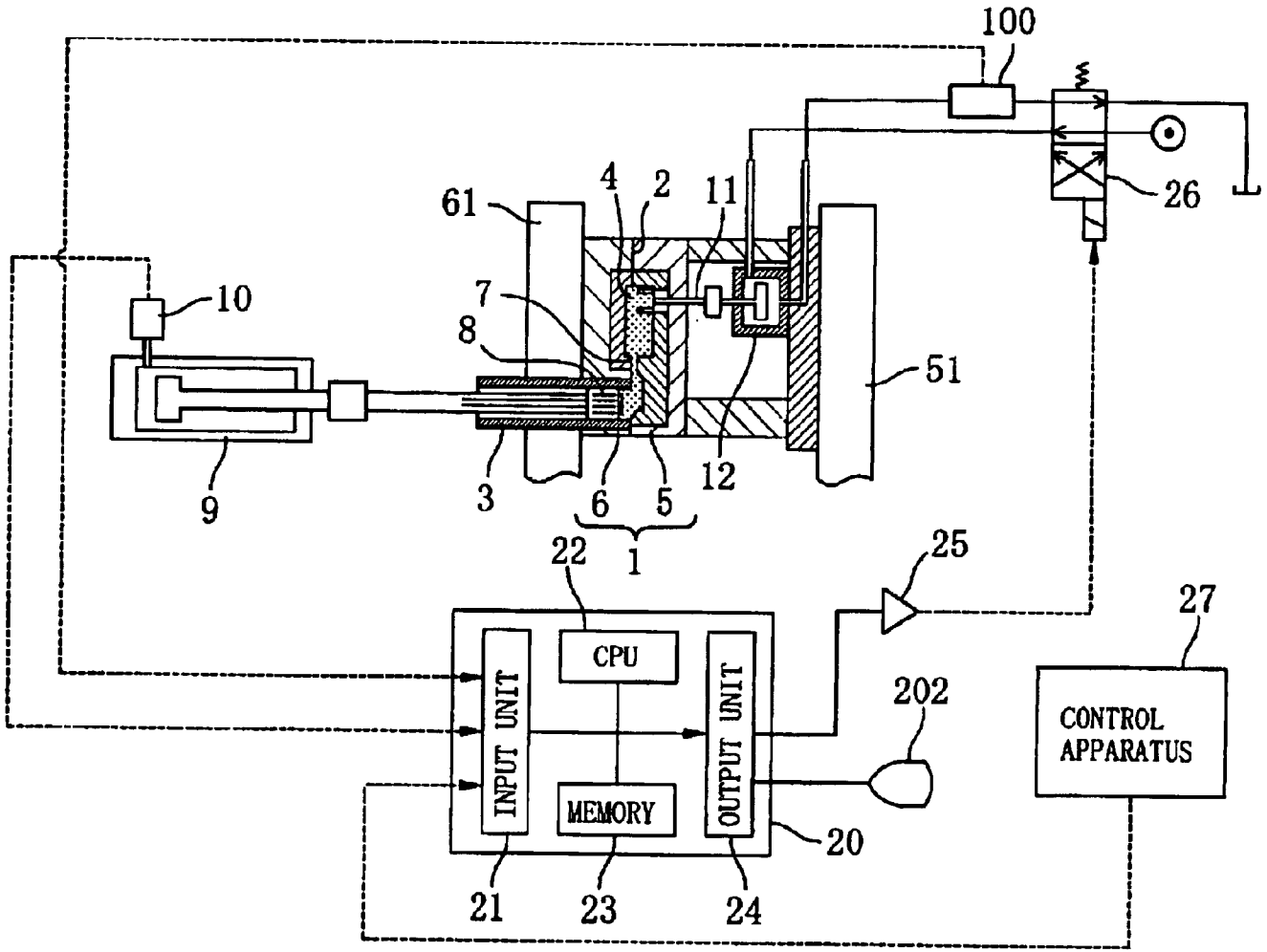
FIG. 1 is a constructional illustration of main portion of an apparatus to execute the present invention.
Figure 4:
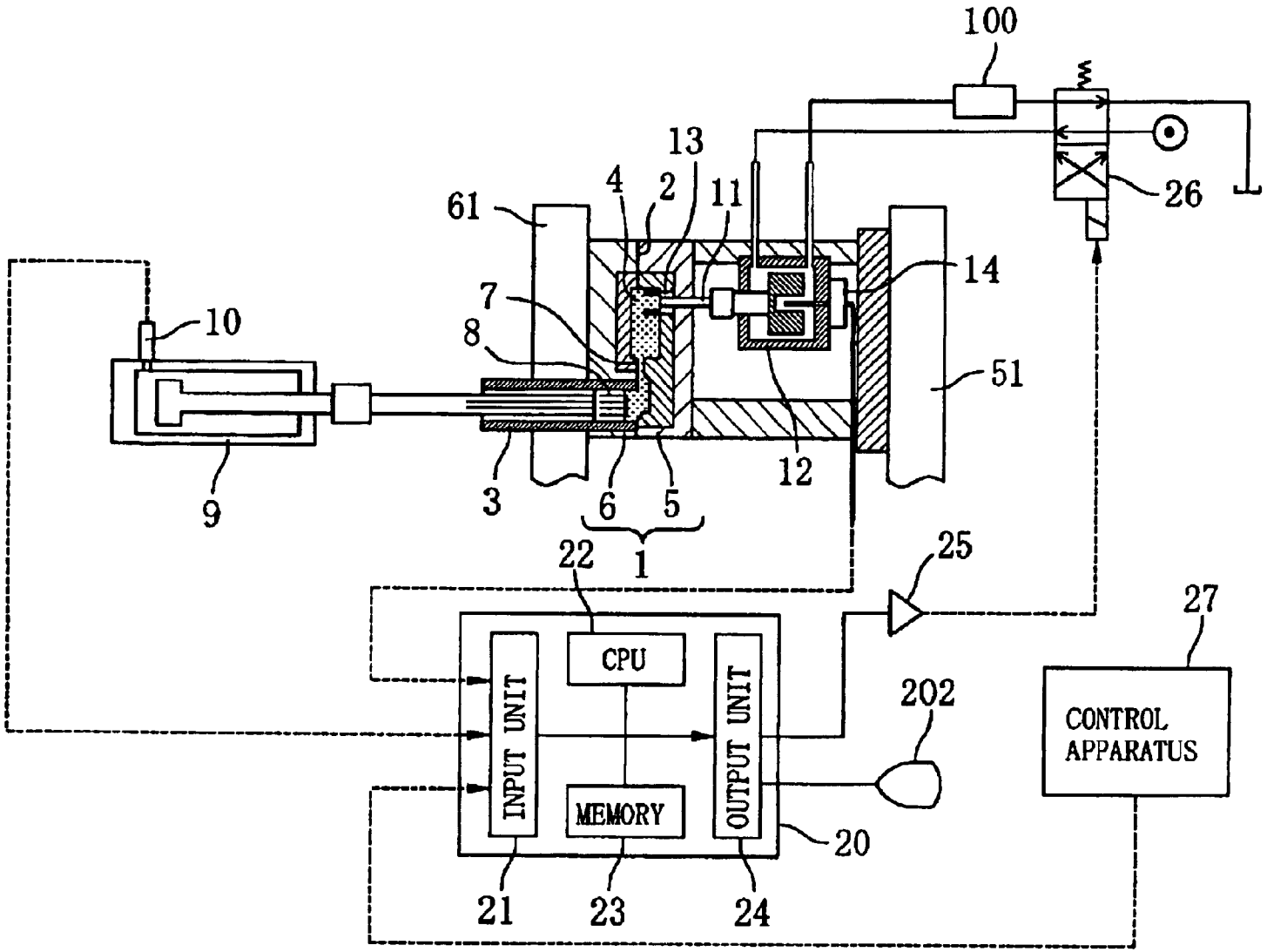
FIG. 4 (PRIOR ART)
FIG. 4 is a constructional illustration of main portion of an apparatus to execute the prior art.
Figure 5:
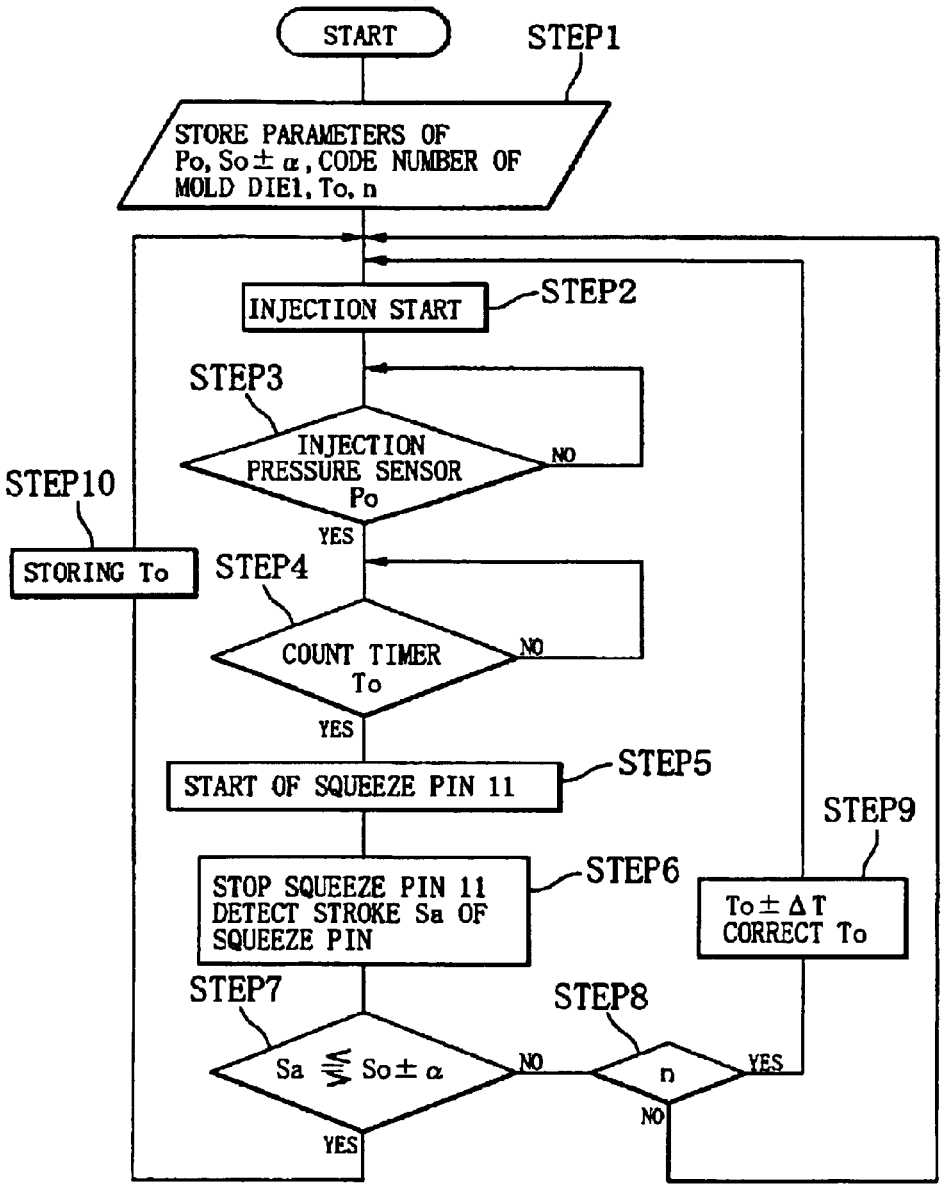
FIG. 5 (PRIOR ART)
FIG. 5 is a flow chart explaining a control process shown in FIG. 4.
Figure 6:
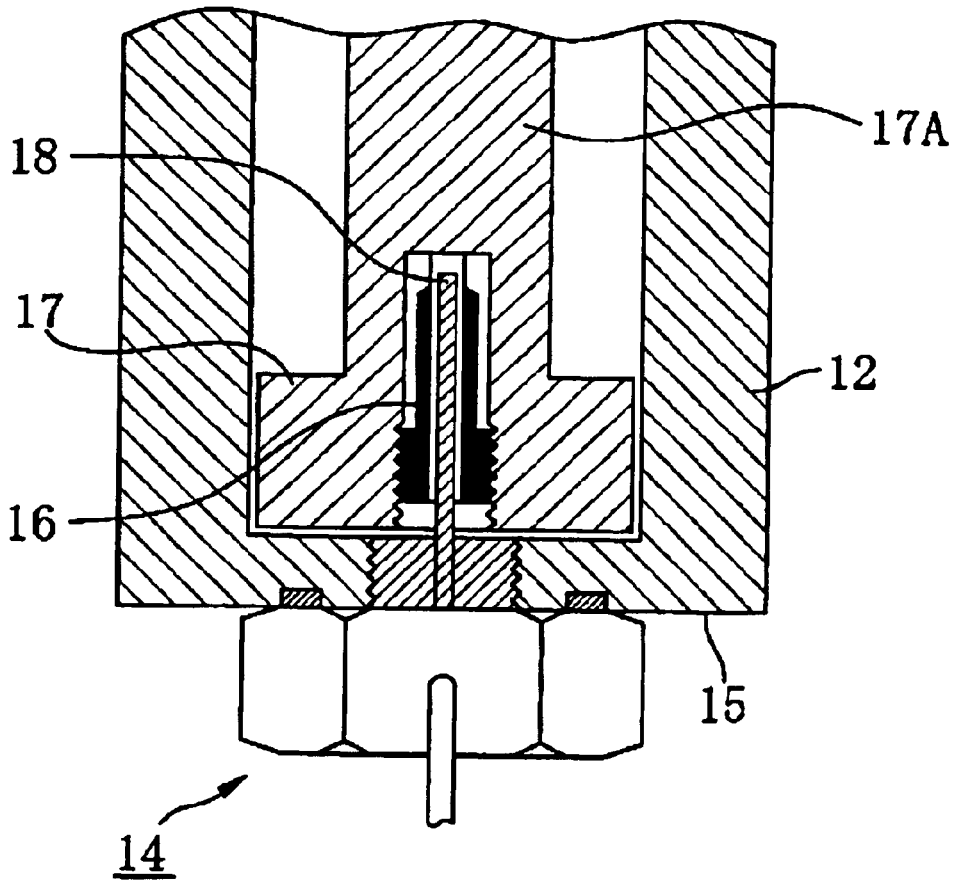
FIG. 6 (PRIOR ART)
FIG. 6 is a fragmentary enlarged sectional view of a stroke sensor showing in FIG. 4
Figure 7:
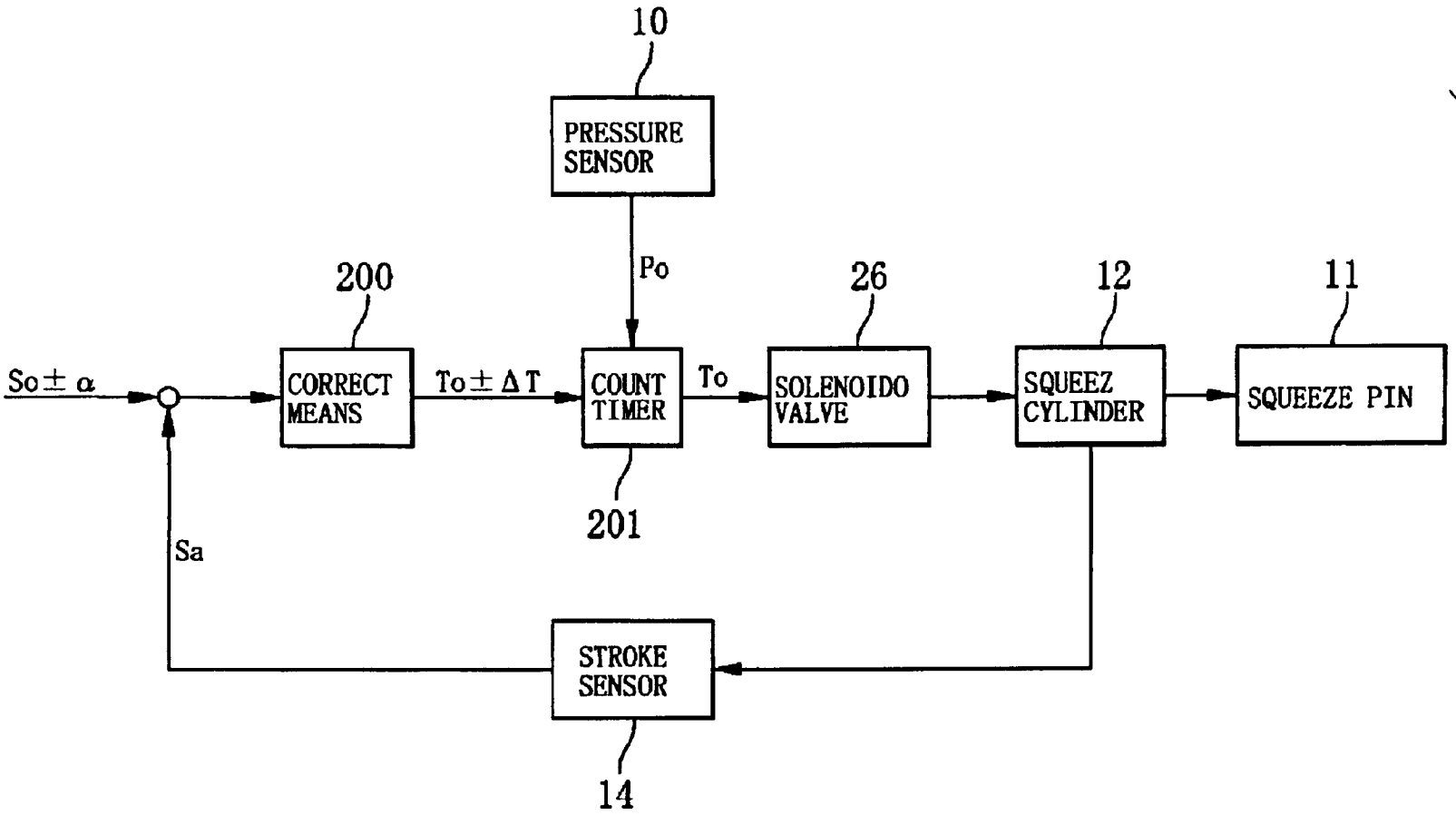
FIG. 7 (PRIOR ART)
FIG. 7 is a control block diagram of an apparatus shown in FIG. 4.
Figure 8:
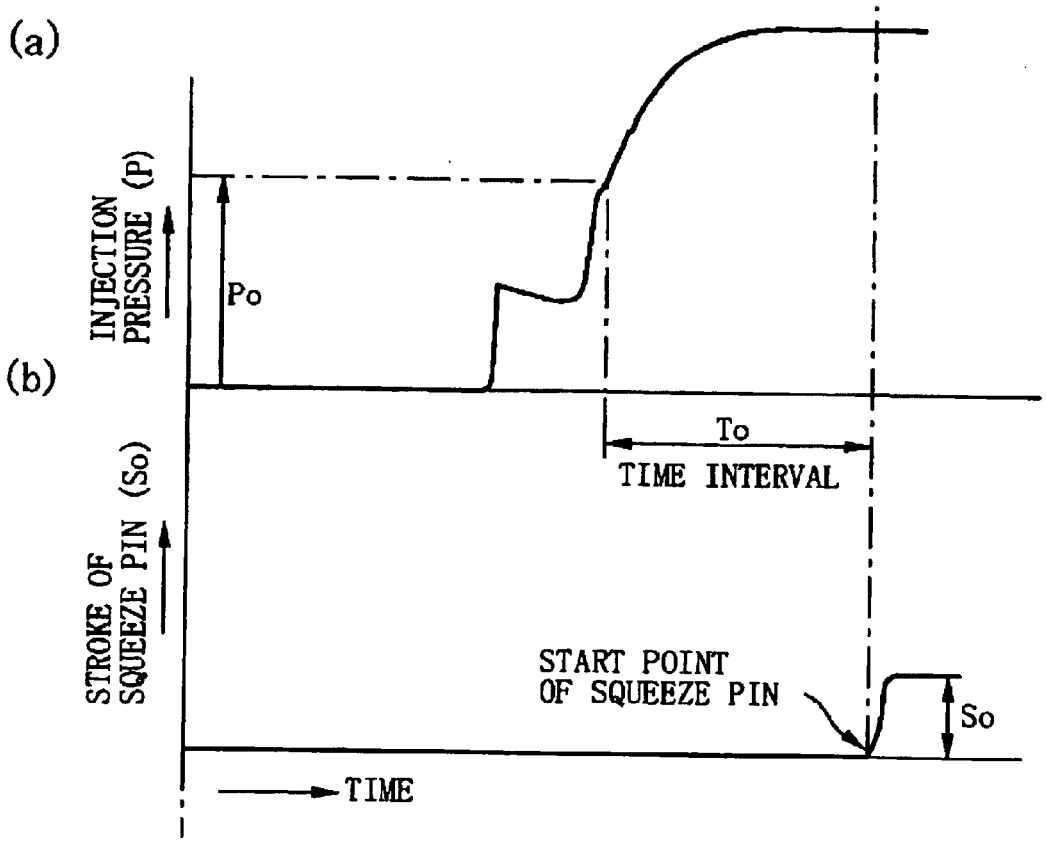
FIG. 8 (PRIOR ART)
FIG. 8 is a waveform illustrative of control operation of an apparatus shown in FIG. 4, wherein (a) is a waveform of injection pressure, (b) is a waveform of stroke of a squeeze pin.
Figure 9:
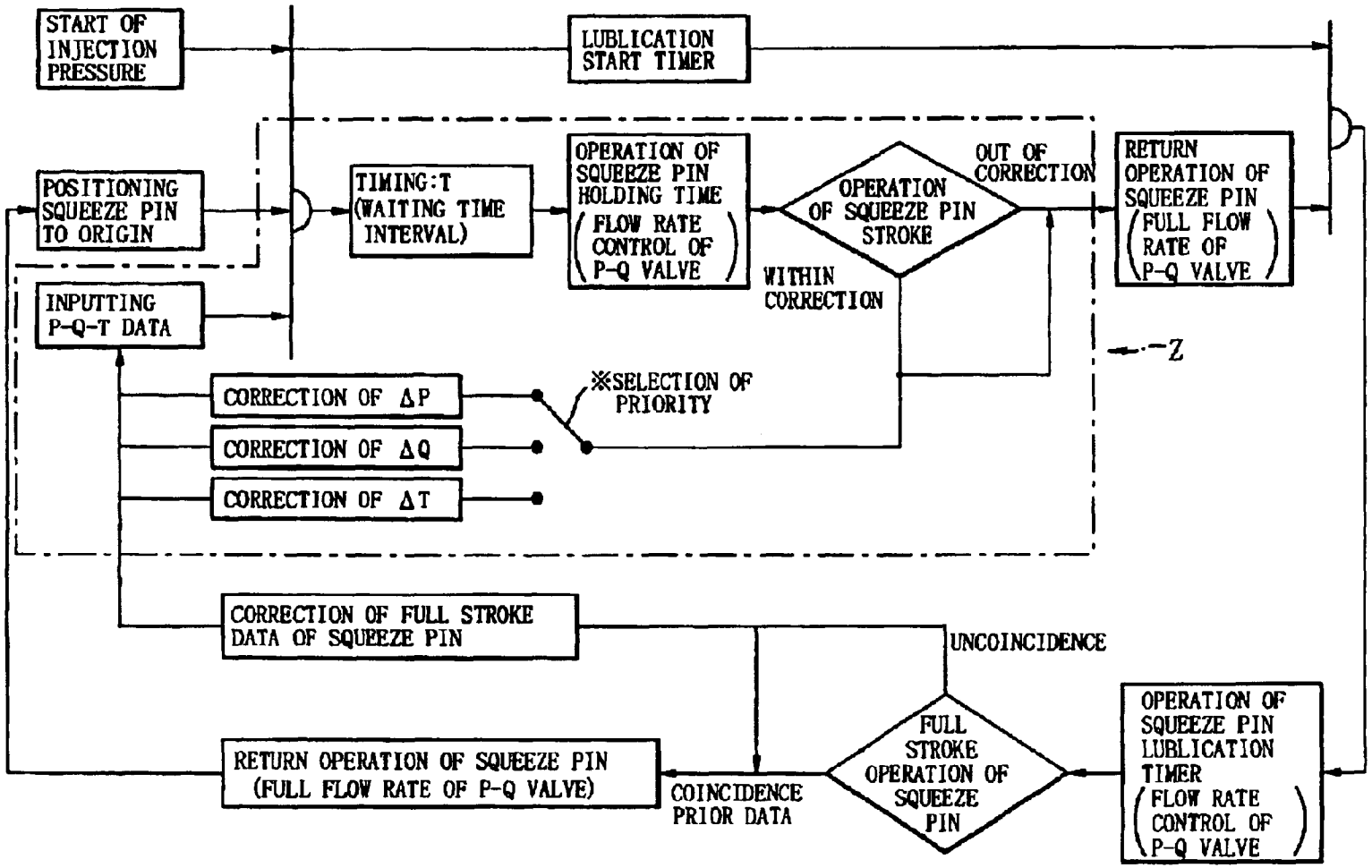
FIG. 9 (PRIOR ART)
FIG. 9 is a control block diagram of a prior art method using small and unit increments $\Delta T$, $\Delta P$, $\Delta Q$ of controlled variables T, P, Q.
Figure 10:
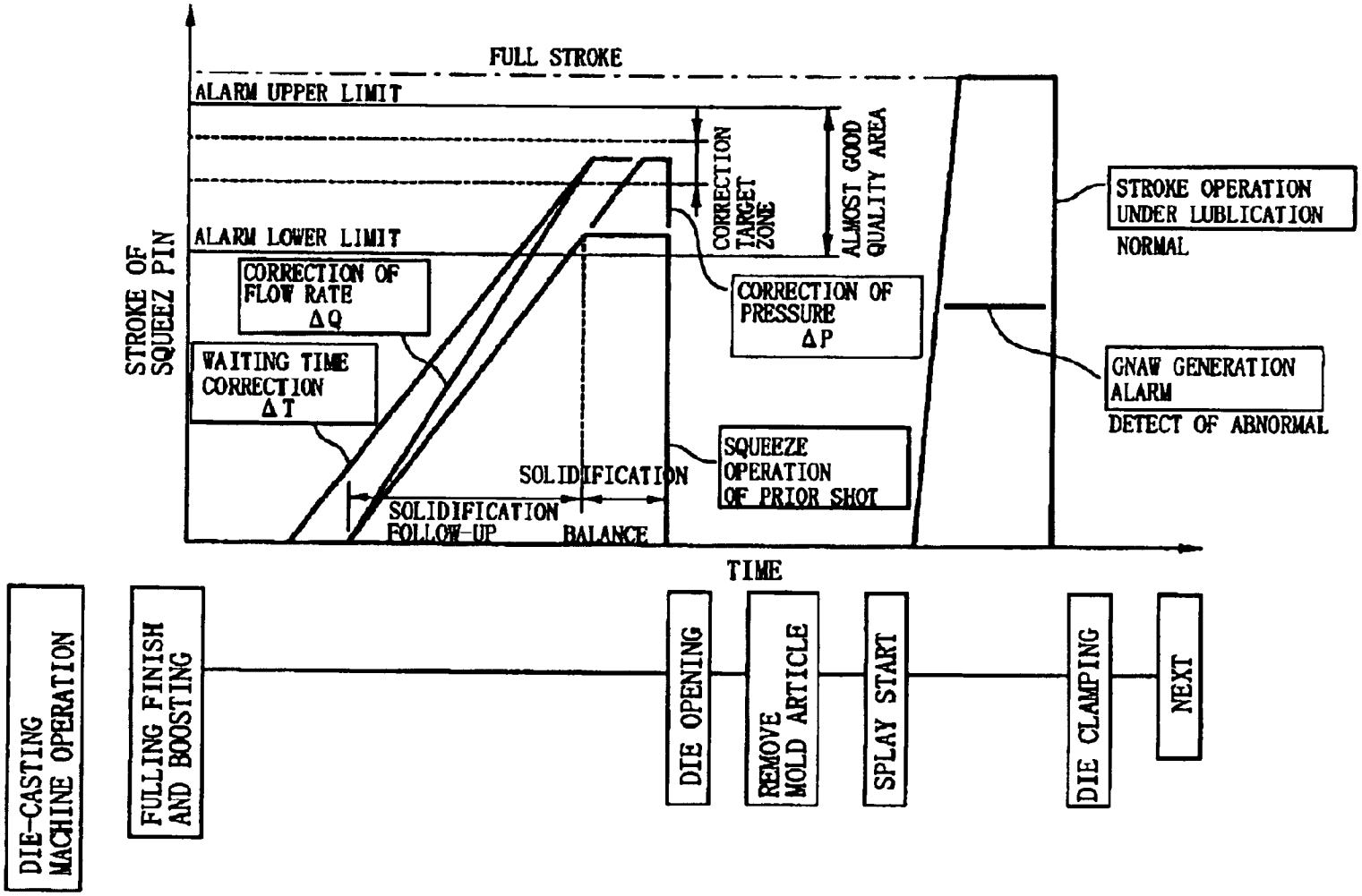
FIG. 10 (PRIOR ART)
FIG. 10 is a waveform illustrative of a squeeze pin's stroke based on time elapse after filled during one shot operation in a prior art shown in FIG. 9.
Figure 11:
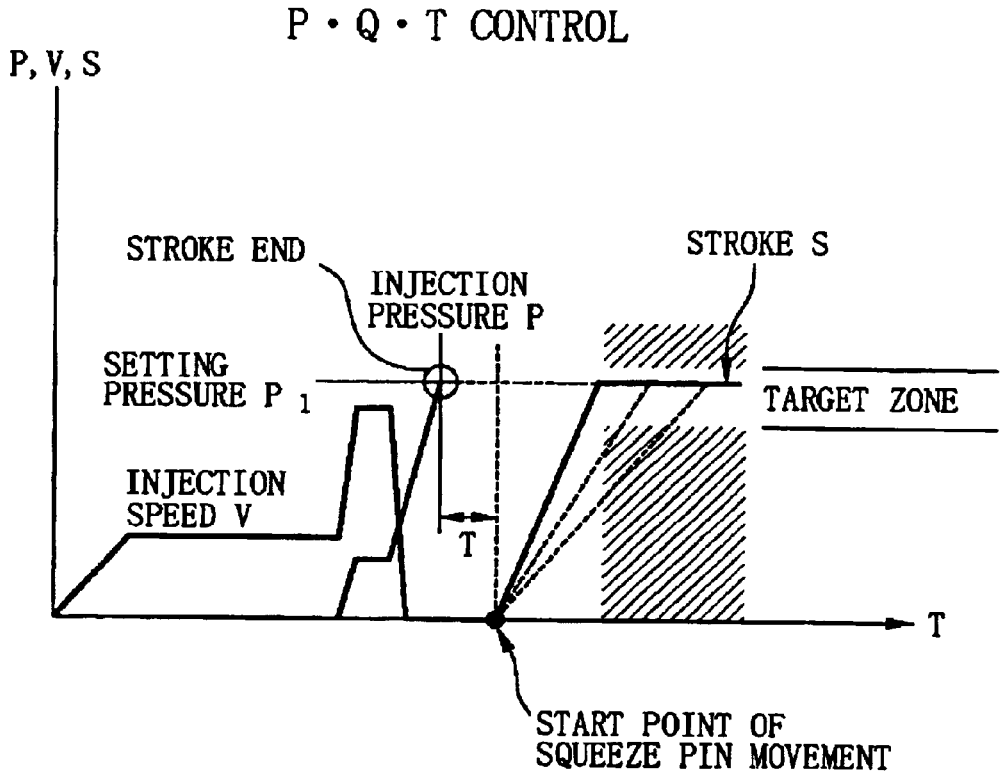
FIG. 11 (PRIOR ART)
FIG. 11 is each waveform illustrative of injection pressure, injection speed and squeeze pin's stroke during one shot operation in a prior art shown in FIG. 9.
Figure 12:
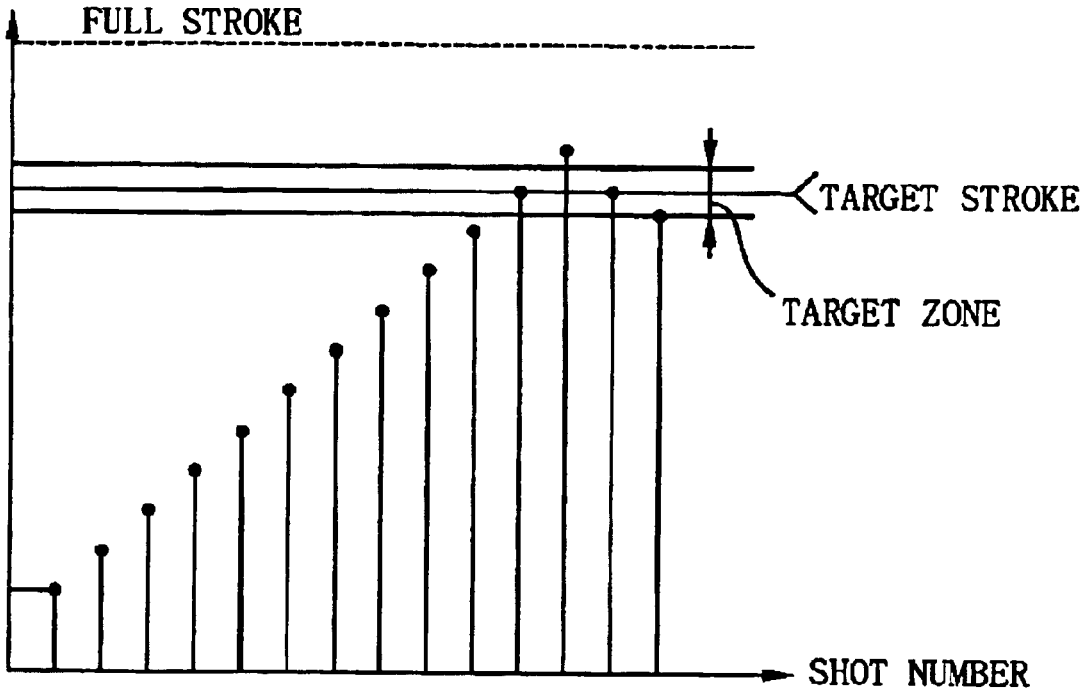
FIG. 12 (PRIOR ART)
FIG. 12 is a graph illustrative of an asymptotical approach for reaching target stroke after initial setting in a prior art shown in FIG. 9.

FIG. 1 indicating a constructional illustration of main portion of an apparatus to execute the present invention is almost the same component and configuration with FIG. 4 except a stroke sensor 14 located inside a squeeze cylinder 12 for directly detecting stroke quantity of a squeeze pin 11 shown in FIG. 4. Namely, in FIG. 1, such a stroke sensor 14 is absent, and instead of the stroke sensor 14, there is provided a flow meter counter 100. The counted numbers at each shot is applied to the input unit 21.

Figure 2:
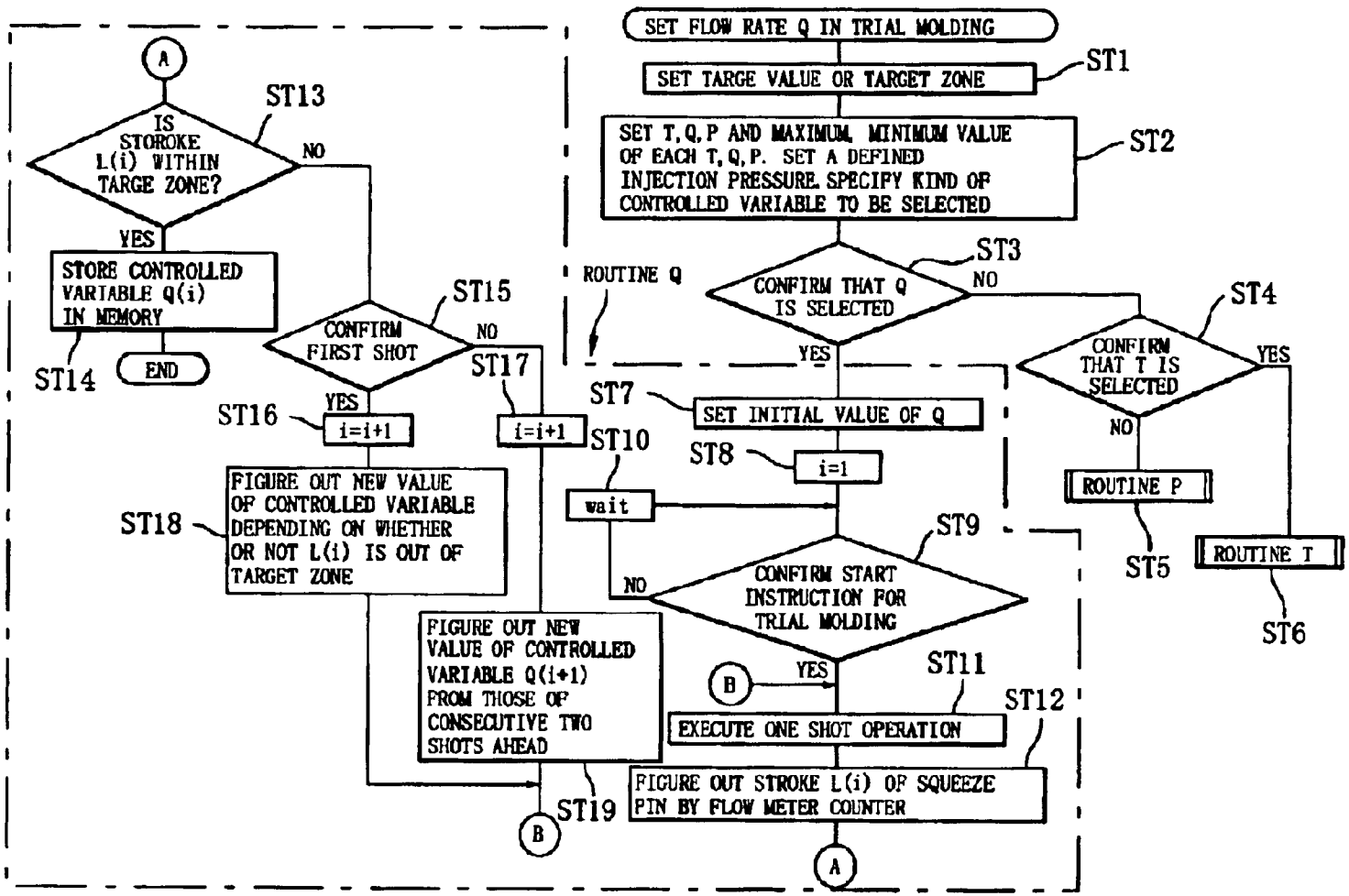
FIG. 2 is a flow chart explaining a drive control method of the present invention.
Figure 3:
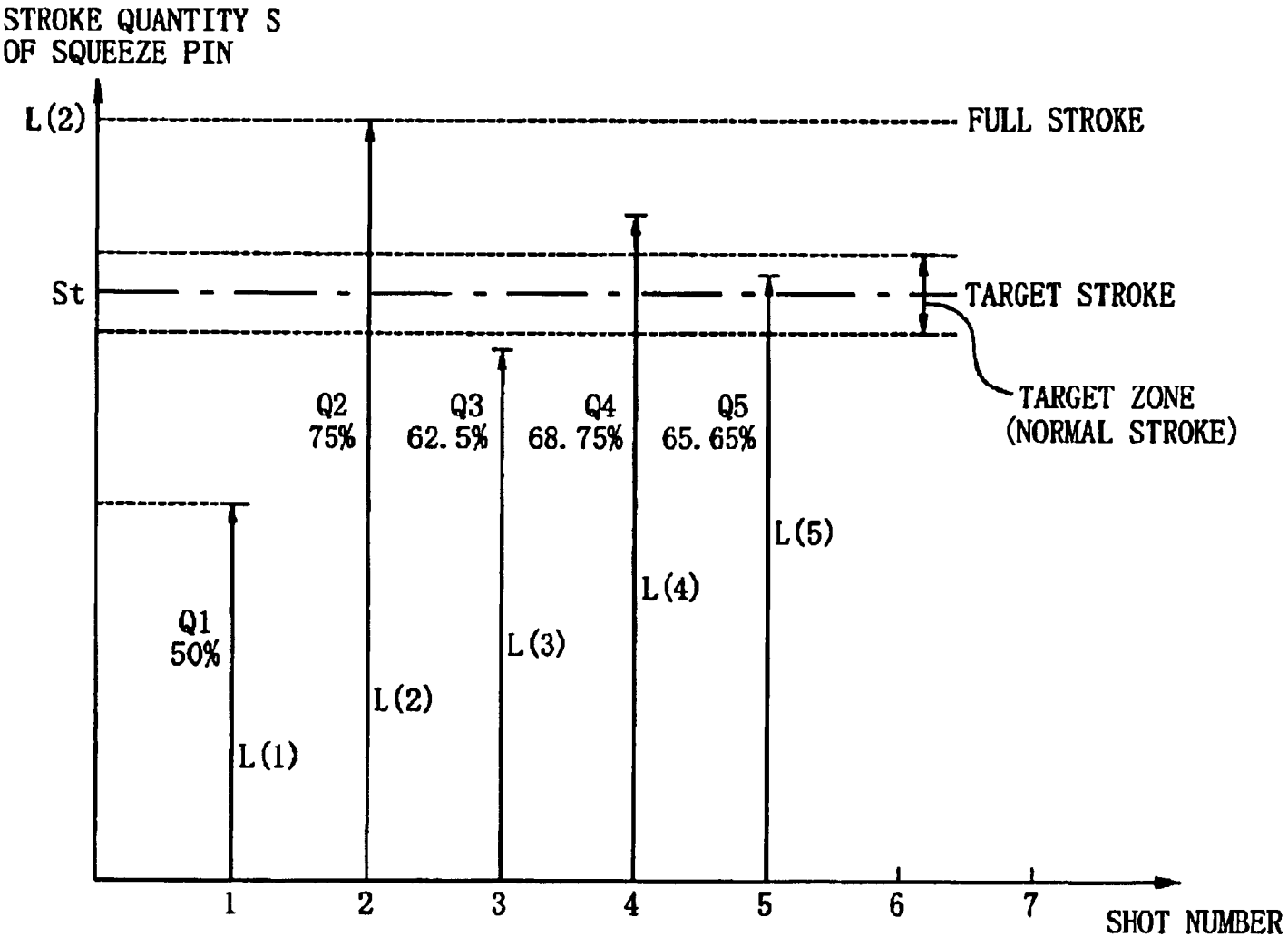
FIG. 3 is a graph illustrative of converging state of a squeeze pin's stroke as the present invention is executed.

FIG. 2 is a flow chart explaining a drive control method of the present invention, and FIG. 3 is a graph illustrative of converging state of a squeeze pin's stroke as the present invention is executed.

In FIG. 2, flow rate Q is used as a controlled variable among the time interval T, injection pressure P and flow ratio Q. At step 1, a target value or target zone of the squeeze pin's stroke is defined. Then, at step 2, maximum and minimum allowable values of each controlled variable T, P, Q are set. Further, a defined value of injection pressure, that is, a reached value of injection pressure for starting stroke operation of squeeze pin 11 is set in the same way. Then, at step 3, it is judged whether or not Q is selected as the controlled variable. At the judging step 3, in case of NO, it is farther judged whether or not T is selected as the controlled variable. In case of NO at the step 4, a processing routine for controlled variable P is executed at the step 5, and incase of YES at the step 4 a processing routine for controlled variable T is executed at the step 6.

As shown in FIG. 2, it is assumed at the step 3 that Q is selected as the controlled variable. So, the detailed processing routines of P and T are omitted in FIG. 2. Hereinafter, only Q routine enclosed with a dashed line will be explained.

At step 7, an initial value Q1 is set as the controlled variable Q. This value Q1 is at 50% of maximum flow rate of a flow control valve. Then, at step 8, the index i is defined to be 1, and then at step 9, it is further judged whether or not a command for starting a trial molding operation is instructed. In case of no command at step 9, waiting is instructed at step 10. In case of starting command at step 9, first shot operation is instructed at step 11. Then, at step 12, a piston stroke quantity L(i) of the squeeze cylinder 12 corresponding to that of squeeze pin 11 during the first shot operation is figured out through count values in the flow meter counter 100.

Then, it is judged whether or not the stroke L(i) is within the target zone.

At the judging step 13, in case of YES, controlled variable Q1 corresponding to the stroke L(i) is stored in the memory 23 at step 14. On the other hand, in case of NO at step 13, it is confirmed at step 15 whether or not the executed operation is initial one. In case of YES (initial operation) at step 15, the index i is incremented by 1 at step 16, and at step 18, new controlled variable Q (i+1) is defined in accordance with a condition whether or not the stroke L(i) is within the target zone. Also, at step 15 the number of shot are more than 2, the index i is incremented (i=i+1) at step 17. Then, at step 19 new controlled variable Q (i+1) is figured out based on controlled variables of two consecutive shots ahead. The new controlled variable Q (i+1) figured out at step 18 or 19 is executed through merging point B at step 11. Thus, by repeating several times loop of the steps from merging point A to merging point B, the stroke L (i) approaches target zone.

FIG. 3 is a graph illustrative of converging state of a squeeze pin's stroke as the present invention is executed.

In FIG. 3, as an initial value Q1 of flow rate, 50% of the maximum flow rate is set. As the result of the first shot operation, the squeeze pin's stroke L (1) did not reach the target zone. So, it is necessary to increase flow rate Q2 in the next shot operation. The flow rate Q2 is defined as an intermediate value between the maximum flow rate (100%) and the previous flow rate (50%), that is, the value of Q2 is 75% of the maximum flow rate. Then, the stroke L (2) of the second shot is over the target zone. So, it is necessary to reduce flow rate Q3 in the third shot operation. The flow rate Q3 is defined as an intermediate value between flow rate Q2 (75%) and the previous flow rate Q1 (50%), that is, the value of Q3 is 62.5% of the maximum flow rate. Then, the stroke L (3) of the third shot is lower than the target zone. So, it is necessary to increase flow rate Q4 in the fourth shot operation. The flow rate Q4 is defined as an intermediate value between flow rate Q3 (62.5%) and the previous flow rate Q2 (75%), that is, the value of Q4 is 68.75% of the maximum flow rate. Then, the stroke L (4) of the fourth shot is over the target zone. So, it is necessary to reduce flow rate Q5 in the fifth shot operation. The flow rate Q5 is defined as an intermediate value between flow rate Q3 (62.5%) and the previous flow rate Q4 (68.75%), that is, the value of Q5 is 65.65%, of the maximum flow rate. Then, the stroke L (5) of the fifth shot operation is within the target zone, that is, normal stroke of the squeeze pin is found out.

In the above, the one embodiment of the present invention is described using FIG. 1, FIG. 2 and FIG. 3. However, the technical scope of the present invention should not be limited to the embodiment shown in FIG. 1 to FIG. 3.

For example, as controlled variables rather than flow rate Q, time interval T or pressure P of hydraulic fluid supplied to the squeeze cylinder may be used.

Further, in FIG. 2 and FIG. 3, the intermediate value is figured out as an arithmetic mean of controlled variables in consecutive two shots ahead. However, instead of the arithmetic mean as the intermediate value, a controlled variable can be modified so as to be proportional to a difference between a detected stroke value and a target value thereof.

According to the present invention, the drive control method for squeeze pin is executed in a way that at least one of the controlled variables Q, P and T is modified during trial molding so that the detected stroke of the squeeze pin approaches and converges the target value or zone gradually. Therefore, a number of trial shot operation for setting a normal stroke of tho squeeze pin can be greatly reduced, and a value of the controlled variable in accordance with the target value or zone can be found out certainly and in a short time without knowledge of expert level.

While preferred embodiments of the present invention have been describe, using specific terms, such description is for illustrative purpose, and it is to be understood that changes and variations may be made without departing from the spirit or scope of the following claims.

What is claimed is:

1. In a drive control method for pushing a squeeze pin slidably mounted on a squeeze cylinder in a mold die into a mold cavity formed in conformity with a desired mold article in accordance with solidification processes of molten metal in the cavity after the molten metal is filled therein, said method comprising:

setting a target value or zone on a stroke quantity of said squeeze pin for molding said mold article;

defining values of a control variable;

executing first trial molding for said mold article at least one time based on the defined values of said control variable, and detecting each actual stroke quantity of the squeeze pin during said trial molding;

firstly modifying or holding said control variable by at least one of:

defining intermediate values between said defined values and maximum values of said control variable to be allowed as new values of said control variable in case that said actual stroke quantities detected during said first trial molding are less than said target value or zone, defining intermediate values between said defined values and minimum values of said control variable to be allowed as new values of said control variable in case that said actual stroke quantities detected during said first trial molding are larger than said target value or zone, and holding the defined values in case that the actual stroke quantities are within the target value or zone;

executing second trial molding for said article at least one time based on said firstly modified or held values of said control variable, and detecting each actual stroke quantity of the squeeze pin during said second trial molding;

secondly modifying said control variable by defining intermediate values between the modified values and the values immediately before said firstly modifying as new values of the controlled variable in case that the actual stroke quantities of the squeeze pin during the second trial molding are out of target value or zone;

executing third trial molding for said article at least one time based on the secondly modified values of said control variable, and as the result holding the secondly modified values as that of said control variable thereafter in case that the actual stroke quantities of the squeeze pin during the third trial molding are within said target value or zone, and determining intermediate values between the secondly modified values of said control variable and the values immediately before said secondly modifying in case that the actual stroke quantities of the squeeze pin during the third trial molding are out of the said target value or zone.

2. The drive control method of claim 1, wherein said firstly modifying comprises determining an arithmetic mean as said intermediate values.

3. The drive control method of claim 1, wherein said control variable comprises at least one of a time lag T, a flow rate Q, and a supply pressure P.

* * * * *